US009278459B2

(12) United States Patent
Block

(10) Patent No.: US 9,278,459 B2
(45) Date of Patent: Mar. 8, 2016

(54) ROTARY BLADE REPLACEMENT APPARATUS AND METHOD

(71) Applicant: Fiskars Brands, Inc., Madison, WI (US)

(72) Inventor: Andrew P. Block, Middleton, WI (US)

(73) Assignee: Fiskars Brands, Inc., Madison, WI (US)

( * ) Notice: Subject to any disclaimer, the term of this patent is extended or adjusted under 35 U.S.C. 154(b) by 339 days.

(21) Appl. No.: 13/790,664

(22) Filed: Mar. 8, 2013

(65) Prior Publication Data

US 2014/0165358 A1 Jun. 19, 2014

Related U.S. Application Data

(60) Provisional application No. 61/738,155, filed on Dec. 17, 2012.

(51) Int. Cl.

| | |
|---|---|
| ***B26D 7/26*** | (2006.01) |
| ***B26B 29/02*** | (2006.01) |
| ***B67B 7/46*** | (2006.01) |
| ***B26B 7/00*** | (2006.01) |
| ***B65B 69/00*** | (2006.01) |
| ***B26D 1/20*** | (2006.01) |
| *B26B 27/00* | (2006.01) |

(52) U.S. Cl.

CPC ..... *B26D 7/2621* (2013.01); *B26D 1/205* (2013.01); *B26B 27/005* (2013.01); *B26B 29/02* (2013.01); *B26D 7/2628* (2013.01); *B65B 69/0033* (2013.01); *B67B 7/30* (2013.01); *Y10T 29/4973* (2015.01); *Y10T 29/53961* (2015.01)

(58) Field of Classification Search

CPC .... B26D 7/2621; B26D 7/2628; B26D 1/205; Y10T 29/53961; Y10T 29/4973; B26B 27/005; B26B 29/02; B65B 69/0033; B67B 7/30

USPC ..... 29/402.01, 402.08, 281.1, 244–280; 7/113, 158; 30/93, 102, 2, 125; 83/954

See application file for complete search history.

(56) References Cited

U.S. PATENT DOCUMENTS

| | | | | | |
|---|---|---|---|---|---|
| 3,802,080 | A | * | 4/1974 | Peter | 30/377 |
| 4,281,458 | A | * | 8/1981 | Okada | 30/162 |
| 4,586,256 | A | * | 5/1986 | Weimann | 30/162 |
| 4,601,103 | A | * | 7/1986 | Sugiyama | 30/162 |
| 5,101,564 | A | * | 4/1992 | Melter | 30/319 |
| 5,144,749 | A | * | 9/1992 | Chen | 30/319 |
| 5,299,355 | A | * | 4/1994 | Boda et al. | 30/162 |
| D346,542 | S | * | 5/1994 | Birkholz | D8/98 |
| 5,355,588 | A | * | 10/1994 | Brandenburg et al. | 30/319 |
| 5,493,781 | A | * | 2/1996 | Saito | 30/162 |
| D388,305 | S | * | 12/1997 | Schulz et al. | D8/98 |

(Continued)

*Primary Examiner* — David Bryant
*Assistant Examiner* — Bayan Salone
(74) *Attorney, Agent, or Firm* — Foley & Lardner LLP

(57) ABSTRACT

An apparatus for presenting a replacement blade from a cartridge includes a body and a carrier. The body includes a first side and a second side opposite the first side, a first position and a second position laterally spaced from the first position, and a trough aligned with the second position. The carrier is slidably coupled to the body and movable between the first position and the second position. When the carrier is in the first position, the carrier couples to a blade if a blade is present in the first position. When the carrier is in the second position, the carrier decouples from the blade such that the blade is deposited in the trough, if a blade is coupled to the carrier. When the carrier moves from the first position to the second position, the carrier causes a blade to move from the first position to the second position.

21 Claims, 7 Drawing Sheets

(56) References Cited

U.S. PATENT DOCUMENTS

| | | | | |
|---|---|---|---|---|
| 5,765,289 | A * | 6/1998 | Schulz et al. | 30/319 |
| 5,909,930 | A * | 6/1999 | Ragland et al. | 30/125 |
| 6,226,824 | B1 * | 5/2001 | Hopson et al. | 7/158 |
| 6,415,514 | B1 * | 7/2002 | Chun | 30/162 |
| 6,438,850 | B2 * | 8/2002 | Young et al. | 30/162 |
| 6,460,254 | B1 * | 10/2002 | Mori et al. | 30/286 |
| 6,513,246 | B2 * | 2/2003 | Ping | 30/125 |
| 6,643,936 | B2 * | 11/2003 | Carlson et al. | 30/162 |
| 6,829,827 | B2 * | 12/2004 | Tseng | 30/162 |
| 7,073,263 | B2 * | 7/2006 | Kawasaki | 30/292 |
| 7,204,023 | B2 * | 4/2007 | Chang | 30/319 |
| 7,395,600 | B2 * | 7/2008 | Fossella | 30/162 |
| 7,418,784 | B2 * | 9/2008 | Fossella | 30/162 |
| 7,451,761 | B2 * | 11/2008 | Hickey et al. | 128/203.21 |
| D582,239 | S * | 12/2008 | Eby et al. | D8/98 |
| 7,464,470 | B2 * | 12/2008 | Grosh et al. | 30/2 |
| 7,533,467 | B2 * | 5/2009 | Fossella | 30/162 |
| 7,774,943 | B2 * | 8/2010 | Ireland | 30/162 |
| 8,046,922 | B2 * | 11/2011 | Eby | B26B 29/02 30/151 |
| 8,661,955 | B2 * | 3/2014 | Wu | 83/455 |
| 8,793,881 | B2 * | 8/2014 | Rowlay et al. | 30/162 |
| 8,793,882 | B2 * | 8/2014 | Kanemoto et al. | 30/162 |
| 8,997,358 | B2 * | 4/2015 | Huang | 30/162 |
| 2005/0028380 | A1 * | 2/2005 | Fossella | 30/162 |
| 2006/0059693 | A1 * | 3/2006 | Fossella | 30/125 |
| 2006/0242841 | A1 * | 11/2006 | Fossella | 30/162 |
| 2007/0028463 | A1 * | 2/2007 | Chan | 30/319 |
| 2007/0028738 | A1 * | 2/2007 | Chan | 83/485 |
| 2008/0010839 | A1 * | 1/2008 | Eby et al. | 30/319 |
| 2009/0183378 | A1 * | 7/2009 | Eby | B26B 29/02 30/391 |

* cited by examiner

ROTARY BLADE REPLACEMENT APPARATUS AND METHOD

CROSS-REFERENCE TO RELATED APPLICATIONS

The present application claims priority to U.S. Provisional Patent Application No. 61/738,155, filed Dec. 17, 2012. The contents of U.S. Provisional Patent Application No. 61/738,155 are incorporated herein by reference in their entirety.

BACKGROUND

The present application relates generally to the field of rotary cutters. The present application relates more specifically to the field of apparatus and methods for replacing a blade on a rotary cutter.

Rotary blades can be difficult to handle because they are relatively thin, with a circular shape in which the entire outer edge is sharpened. The blades may be packaged with coating, such as a light rust-preventative lubricant. When sold in quantity, the blades may be stacked together, and can be difficult to separate because of the coating.

SUMMARY

One embodiment relates to an apparatus for presenting a replacement blade from a cartridge. The apparatus includes a body with a bottom side and a top side opposite the bottom side; a first position and a second position laterally spaced from the first position; and a trough aligned with the second position. The apparatus further includes a carrier slidably coupled to the body, the carrier movable between the first position and the second position. When the carrier is in the first position, the carrier couples to a blade if a blade is present in the first position. When the carrier is in the second position, the carrier decouples from the blade such that the blade is deposited in the trough, if a blade is coupled to the carrier. When the carrier moves from the first position to the second position, the carrier causes a blade to move from the first position to the second position.

Another embodiment relates to an apparatus for presenting a replacement blade from a cartridge. The apparatus includes a body with a bottom side and a top side opposite the bottom side; a first position and a second position laterally spaced from the first position; at least one finger proximate the first position; and a trough aligned with the second position. The apparatus further includes a cartridge coupled to the first side of the body. The cartridge has at least one rotary blade therein and a spring providing a biasing force against the at least on rotary blade. The apparatus further includes a carrier slidably coupled to the second side of the body and movable between the first position and the second position.

Yet another embodiment relates to a method for replacing a blade of a rotary cutting tool. The method includes providing a body comprising a first position and a second position laterally spaced from the first position, and a trough aligned with the second position; providing a carrier slidably coupled to the body, the carrier movable between the first position and the second position; and providing a blade proximate the first position. The method further includes coupling the carrier to the blade; moving the carrier from the first position to the second position; and depositing the blade in the trough.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a rotary blade replacement apparatus and components thereof are shown according to an exemplary embodiment.

Before discussing further details of the rotary blade replacement apparatus and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1:
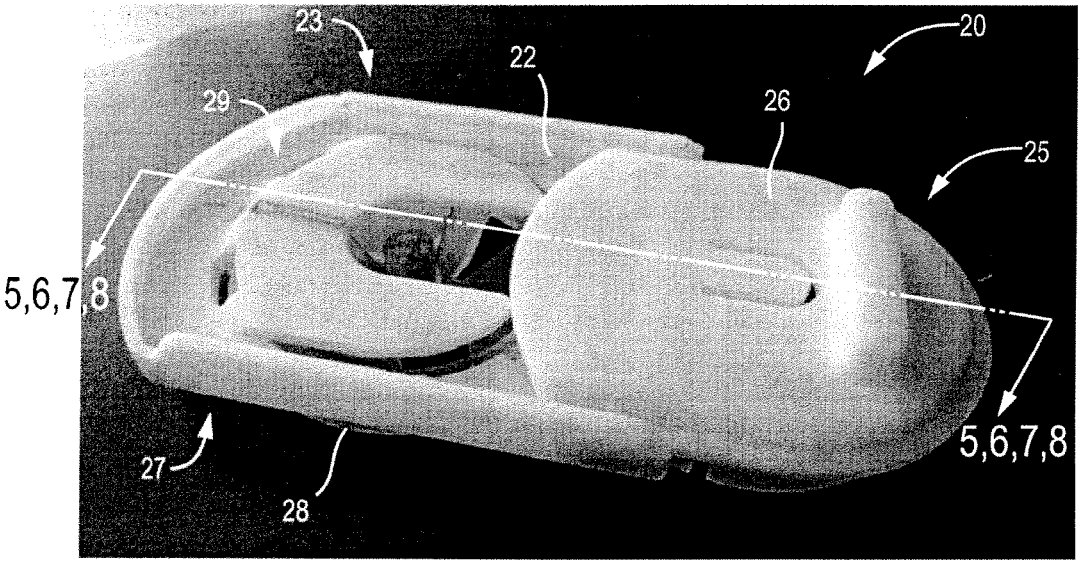
FIG. 1 is a top perspective view of a rotary blade replacement apparatus with the blade carrier in the second position, in accordance with an exemplary embodiment.
Figure 4:
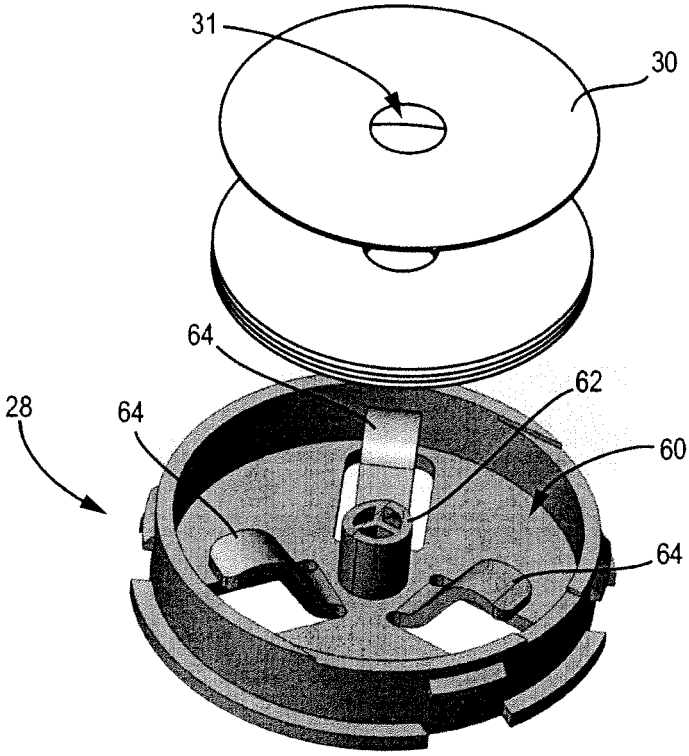
FIG. 4 is a top perspective view of the cartridge of the rotary blade replacement apparatus of FIG. 1.

Referring to FIG. 1, a rotary blade replacement apparatus 20 is shown according to an exemplary embodiment. The apparatus 20 is configured to facilitate the removal and storage of old blades from a device (e.g., a rotary cutting device) and provide a new blade for the device. The apparatus 20 includes a main body 22 with a left end 23 (e.g., left side, left end portion, etc.) and a right end 25 (e.g., right side, right end portion, etc.), a bottom side 27 (e.g., bottom portion, bottom surface, etc.), and a top side 29 (e.g., top portion, top surface, etc.). A carrier 26 is slidably coupled to the body 22 and is utilized to engage and move a blade 30 of the type depicted in FIG. 4 from the left end 23 to the right end 25. In an exemplary embodiment, and as represented in FIG. 4, a stack of blades 30 may be provided in a cartridge 28 that is coupled to the left end 23 of the body 22. The carrier 26 is configured to index a single new blade 30 from within the cartridge 28 to an installation location on the right end 25 of the body 22. Once the blade 30 is moved to the right end 25 of the body 22 by the carrier 26, the blade 30 may be disengaged from the carrier 26 and coupled to the device. The body 22 may further include a location for the storage for old blades removed from the device, as shown in FIG. 5 and discussed in more detail below.

Figure 2:
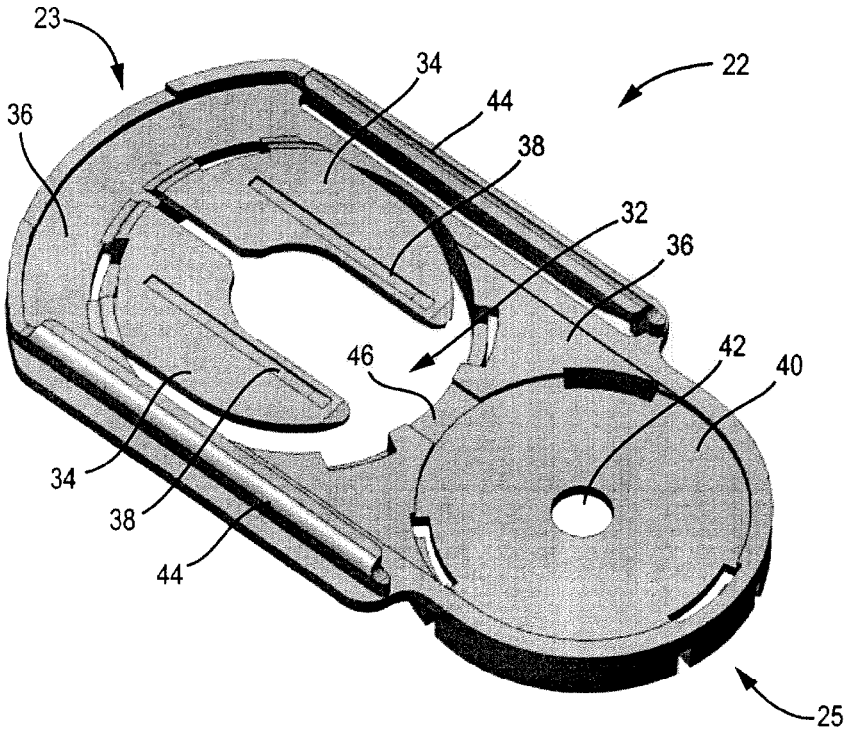
FIG. 2 is a top perspective view of the body of the rotary blade replacement apparatus of FIG. 1.

Referring to FIG. 2, the body 22 of the apparatus 20 is shown according to an exemplary embodiment. The left end 23 of the body 22 includes an opening 32 allowing blades to pass through the body 22 from the bottom side 27 to the top side 29 and a pair of blade stops 34 (e.g., members, fingers, arms, etc.) disposed over the opening. The blade stops 34 are flexible (e.g., resilient, deflectable, etc.) members that are configured to contact the top surface of the topmost blade 30 and control the position of the blade 30 relative to the body 22 and the carrier 26. The blade stops 34 are coupled to the floor 36 of the body 22 at a first or proximal end and free on a second or distal end opposite the first end to allow the blade 30 to move from the left end 23 to the right end 25. Each of the blade stops 34 includes a slot or groove 38 configured to receive a protrusion 56 on the carrier, as described in more detail below. The right end 25 of the body 22 includes a trough 40 (e.g., depression, hollow, recess, etc.) sized to receive a blade moved to the right end 25 by the carrier 26. The trough 40 includes a central opening 42. A recessed path 46 extends from the trough 40 to the opening to provide a clearance for a blade catch 52 of the carrier 26.

Figure 3:
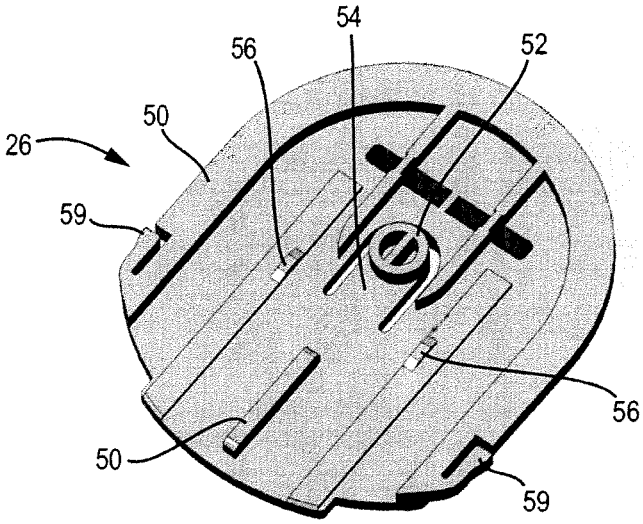
FIG. 3 is a bottom perspective view of a blade carrier for the rotary blade replacement apparatus of FIG. 1.

Referring to FIG. 3, a bottom perspective view of the carrier 26 is shown according to an exemplary embodiment. The edges of the carrier 26 engage a pair of longitudinal guides or rails 44 extending between the left end 23 and the right end 25. The rails 44 couple the carrier 26 to the top of body 22 and allow the carrier 26 to slide relative to the body 22. The underside of the carrier 26 includes one or more bosses 50 providing a contact surface for the top surface of the blade 30. The carrier 26 further includes a blade catch 52 that extends from the underside farther than the bosses 50 and is configured to engage or catch the blade 30 when it is received in the central opening or blade aperture 31 of the blade 30. The blade catch 52 is coupled to a flexible arm 54, allowing the blade catch 52 to be deflected relative to the main body of the carrier 26. According to an exemplary embodiment, the blade apertures 31 are circular and the blade catch 52 is a cylindrical body configured to be received in the circular aperture 31. According to other exemplary embodiments, the blade catch 52 may be shaped to fit other blade aperture shapes (e.g., square, hexagonal, etc.). The carrier 26 further includes one or more protrusions 56. The protrusions 56 align with the corresponding grooves 38 in the blade stops 34. When contacting the blade stops 34, the protrusions 56 bias the blade stops 34 downward, away from the carrier 26. When the protrusions 56 are received in the grooves 38, the blade stops 34 are allowed to move towards the underside of the carrier 26 and return to a rest position.

Figure 5:
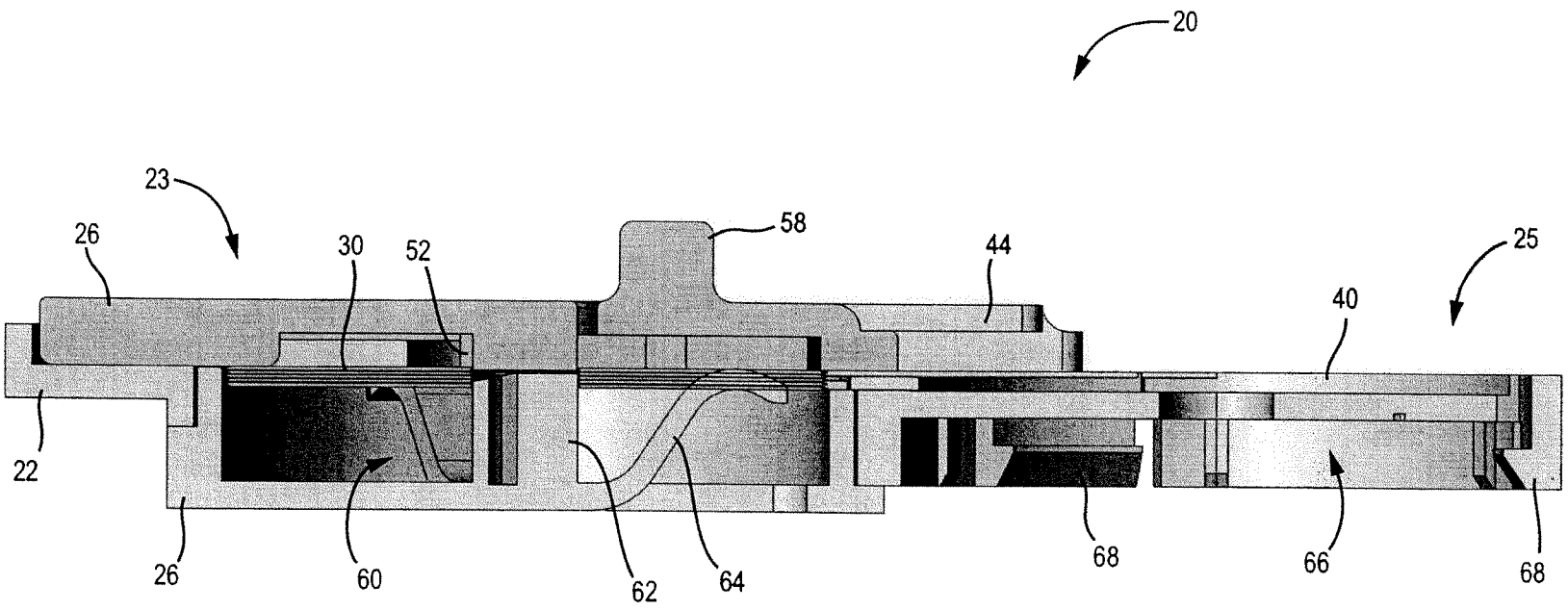
FIG. 5 is a cross-section view of the rotary blade replacement apparatus of FIG. 1 with the blade carrier in the first position, taken along line 5-5.

As shown in FIG. 5, the carrier 26 may include a handle 58 (e.g., a ridge, protrusion, grip, etc.) that may be grasped or otherwise engaged by a user to move the carrier 26 relative to the body 22. In other embodiments, the carrier 26 may have a surface texture (e.g., knurling) to allow a user to engage the carrier 26. The travel of the carrier 26 relative to the body is limited by fingers 59, which extend radially outward from the carrier 26. The fingers 59 are captured by the rails 44 and prevent the carrier 26 from sliding off the body 22.

Referring to FIG. 4, the cartridge 28 is shown according to an exemplary embodiment. The cartridge 28 is configured to hold one or more blades 30 and is coupled (e.g., via snap, bayonet, threaded fastener, etc.) to the bottom of the left end 23 of the body 22 such that the blades 30 are aligned with the opening 32 in the left end 23 of the body 22. According to one embodiment, the cartridge 28 may be pre-loaded with five blades 30 in a stack. The cartridge 28 includes a recess 60 configured to receive the one or more blades 30 and a post 62 extending upward in the recess 60. The post 62 is received in the blade apertures 31 and aligns the blades 30 with each other and the other components of the apparatus 20 (e.g., the carrier 26) when the cartridge 28 is coupled to the body 22. The post 62 limits or constrains the lateral movement of the blades 30, keeping the blades 30 generally centered within the cartridge 28 such that the sharpened edges of the blades 30 do not become dulled by contact with the side wall of the cartridge 28. According to an exemplary embodiment, the post 62 comprises a cylindrical body configured for use with a blade 30 with a circular blade aperture 31. According to other exemplary embodiments, the post 62 may be shaped to fit other blade aperture shapes (e.g., square, hexagonal, etc.). The cartridge 28 further includes one or more biasing features, shown as spring arms 64 in FIG. 4, that bias the stack of blades 30 towards the body 22 and against a stop face (for example, the blade stops 34, the contact surfaces of the bosses 50 on the carrier 26, etc.).

Referring to FIG. 5, the body 22 may further include a storage area 66 for receiving and retaining old blades. The old blade storage area 66 allows for storage of old blades. The entire apparatus 20 can be disposed of (e.g., recycled) to safely dispose of the stored old blades. In other exemplary embodiments, the blades 30 or the entire storage area 66 may be configured to be removed from the apparatus 20 and disposed. According to another embodiment, the apparatus 20 may be configured such that a user can safely remove the blades 30 from the storage area 66 for disposal of the blades 30. The body 22 includes retaining features 68 that hold the old blades in the storage area 66. The storage area 66 is configured to allow for the blades to be added into the storage area 66 directly from the rotary cutting device without a user having to touch the blades. The storage area 66 may be configured to hold any number of blades, which may be chosen to be multiples of the number of blades pre-loaded in the cartridge 28.

Figure 6A:
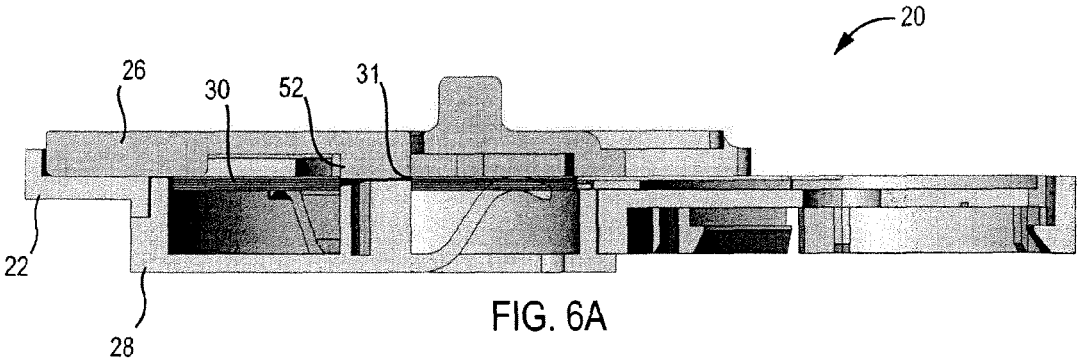
FIGS. 6A-6D are sequential cross-section views showing the carrier moving a blade from the first position to the second position, taken along line 6-6.
Figure 6B:
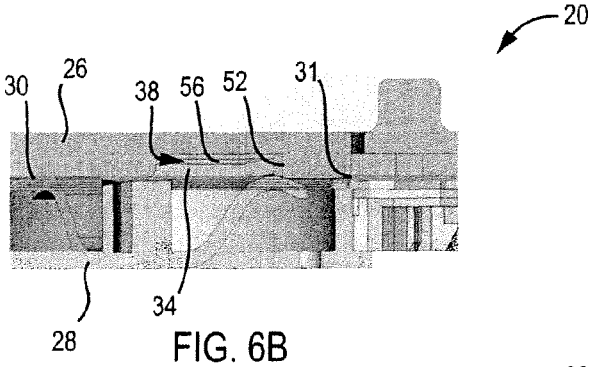

FIGS. 6A-6D show the apparatus 20 with the carrier 26 being moved from a first position to a second position, moving a blade from the left end 23 of the body 22 to the right end 25 of the body 22. According to the exemplary embodiment described, the replacement apparatus 20 transfers the new blade 30 from the cartridge 28 to the trough 40 without touching a sharpened edge of the blade 30. As shown in FIG. 6A, when the carrier 26 is in the first position and is aligned with the opening 32 in the body 22 and the blades 30 in the cartridge 28, the blade catch 52 is received in the blade aperture 31 and makes contact with inner walls of the blade aperture 31. The blade catch 52 extends beyond the bosses 50 by a distance approximately equal to the thickness of the blade 30 to ensure that the blade catch 52 only contacts the inner wall of the blade aperture 31 of the topmost blade 30 (e.g., the blade 30 directly against the bottom face of the blade stops 34 and the bosses 50). As shown in FIG. 6B, the carrier 26 moves the top blade 30 away from the stack of blades 30 held in the cartridge 28 via the engagement of the blade aperture 31 by the blade catch 52 as the carrier 26 is moved away from the first position towards the second position.

Figure 6C:
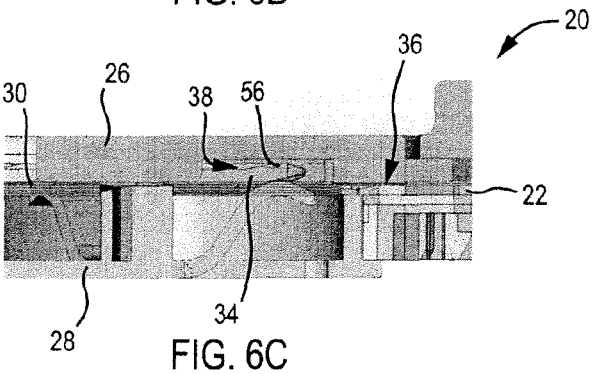
Figure 6D:
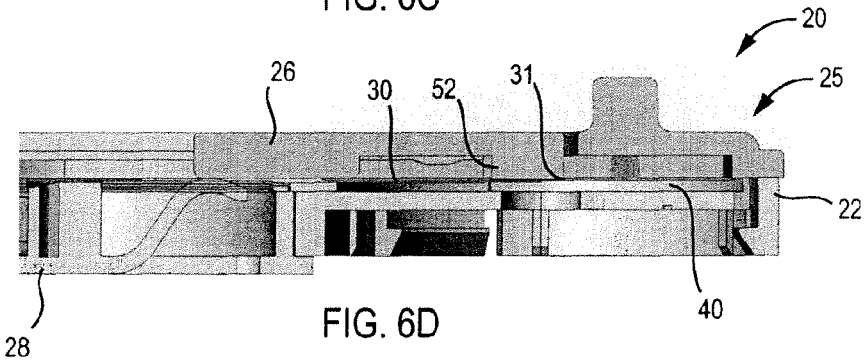
Figure 7:
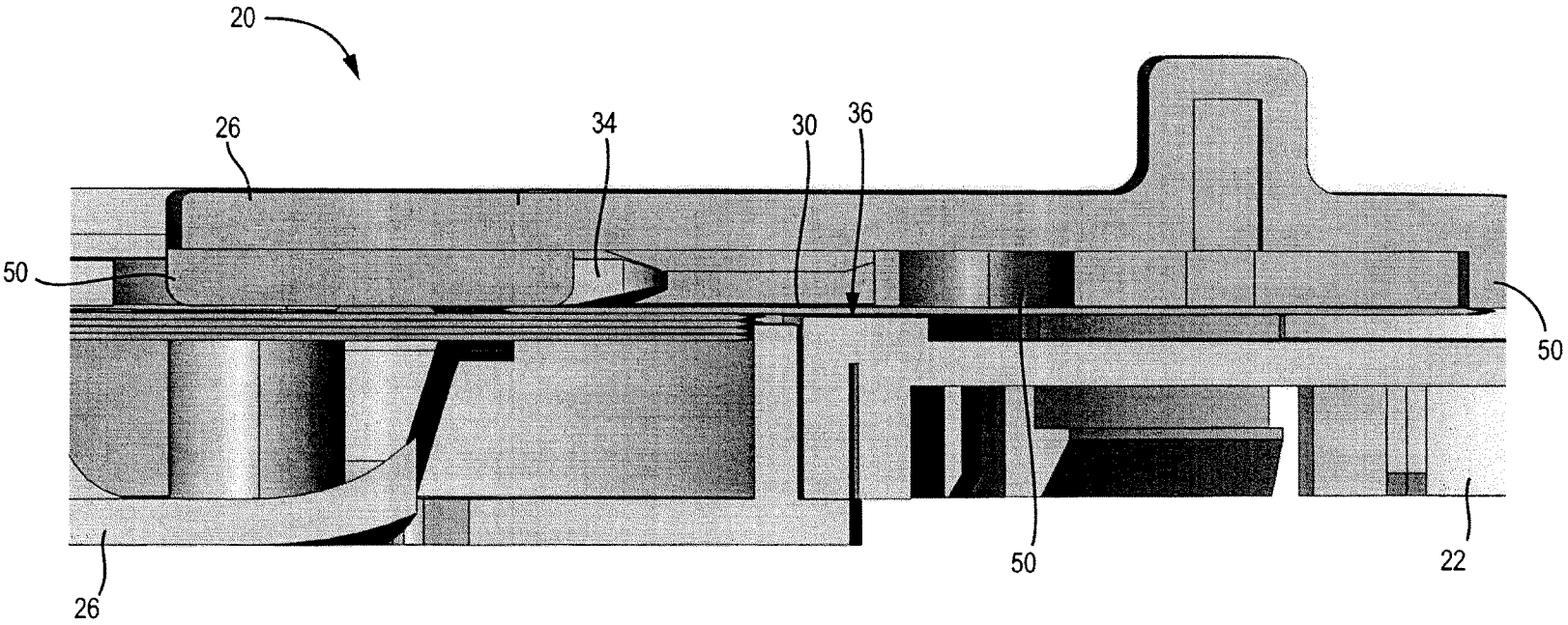
FIG. 7 is a detail cross section view of the rotary blade replacement apparatus of FIG. 1 with the carrier in a position intermediate between the first position and the second position, taken along line 7-7.

As shown in FIG. 6C and FIG. 7, the top blade 30 is supported by multiple surfaces. The bottom of the blade 30 may contact a portion of the floor 36 of the body 22, while the top of the blade 30 may contact the contact surfaces of the bosses 50 extending from the underside of the carrier 26 and the blade stops 34. As the blade clearance protrusions 56 exit the grooves 38 in the blade stops 34, the blade clearance protrusions 56 pass over the distal end of the blade stop 34. The contact between the blade 30 and the floor 36 of the body 22 inhibits downward movement of the blade to decouple the blade 30 from the blade catch 52 of the carrier 26. In addition, the blade 30 is sufficiently resilient to allow enough distortion (flex) to allow downward deflection of the stops 34 without preventing linear travel of the carrier 26 from the left 23 to the right 25. As shown in FIG. 7, the features integral to the body 22 and carrier 26 ensure contact between the blade aperture and the blade catch 52 until the blade 30 is sufficiently above the installation location formed by the trough 40 at the right end 25 of the body 22, at which time the blade 30 is allowed to fall away from the blade catch 52, into the trough 40. In other exemplary embodiments, the carrier may include a deflectable member or portion that can be actuated by a user to push the blade 30 off the blade carrier 52 into the trough 40.

Figure 8A:
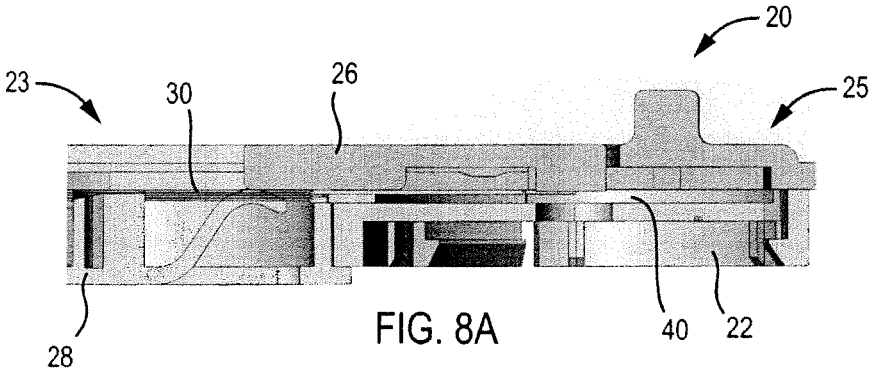
FIGS. 8A-D are sequential cross-section views showing the carrier being moved from the second position to the first position, taken along line 8-8.
Figure 8B:
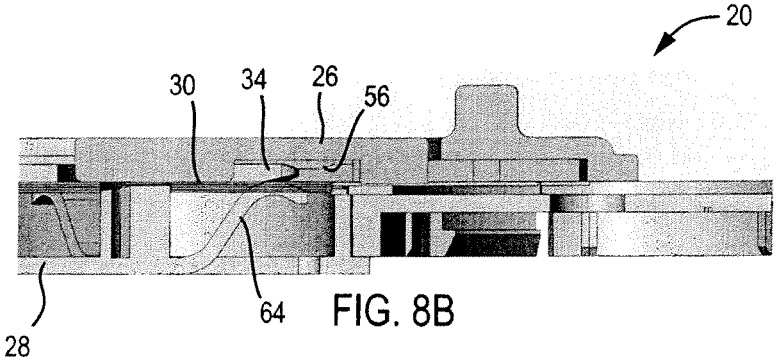
Figure 8C:
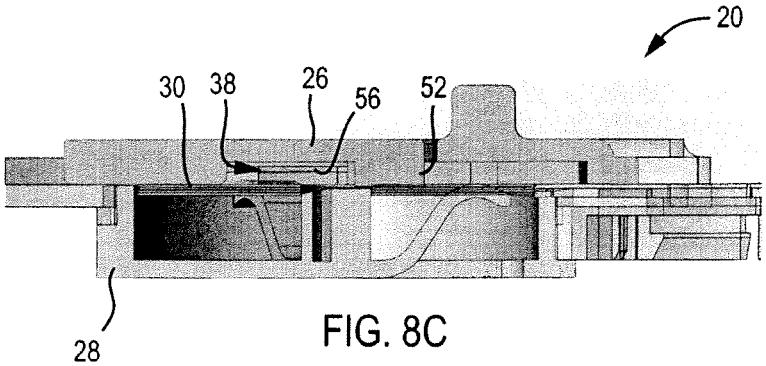
Figure 8D:
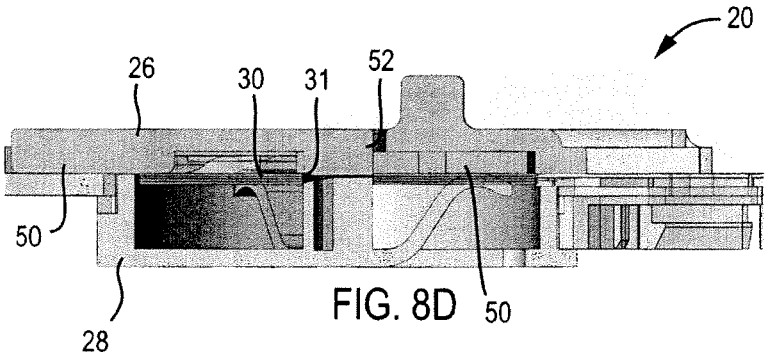
Figure 9A:
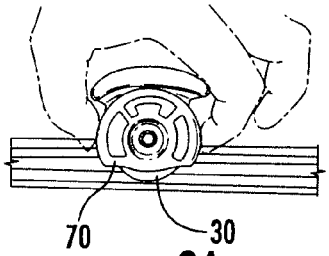
FIGS. 9A-9L are sequential perspective views of a method of replacing a rotary blade in a device utilizing the rotary blade replacement apparatus of FIG. 1.
Figure 9B:
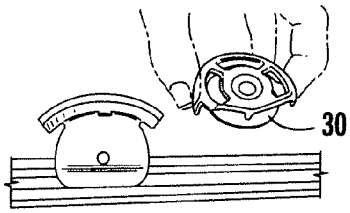
Figure 9C:
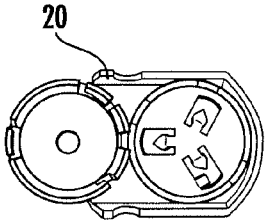
Figure 9D:
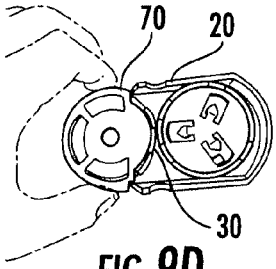
Figure 9E:
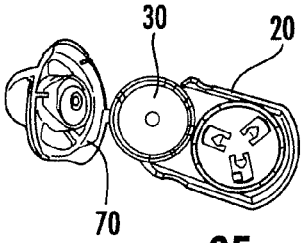
Figure 9F:
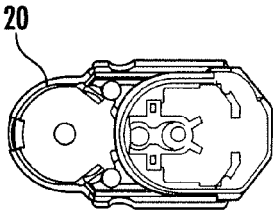
Figure 9G:
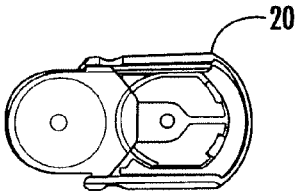
Figure 9H:
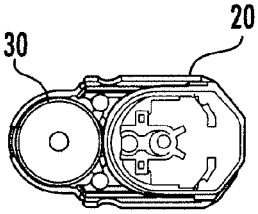
Figure 9I:
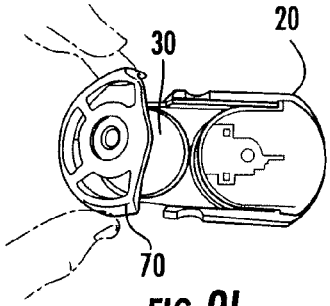
Figure 9J:
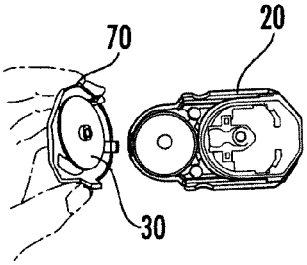
Figure 9K:
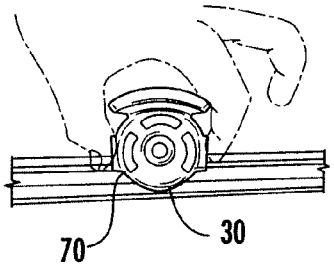
Figure 9L:
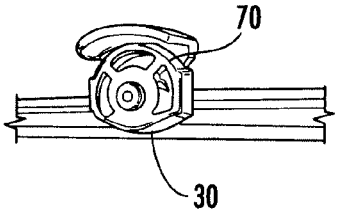

FIGS. 8A-8E show the apparatus with the carrier being moved from the second position to the first position after depositing a blade 30 in the trough 40 at the right end 25 of the body 22, as shown in FIG. 8A. Referring to FIG. 8B, returning from the second position to the first position, the protrusions 56 engage the distal ends of the blade stops 34, causing the blade stops 34 to deflect downward from a first or un-deflected state to a second or deflected state. The deflection of the blade stops 34 pushes any blades 30 in the cartridge 28 downward, deflecting the spring arms 64. The blade catch 52 extends downward farther than the bosses 50. This downward movement of the blade stops 34 and blades 30 is sufficient to create a clearance for the blade catch 52, allowing the blade catch 52 to translate over and past the sharpened edges of the blades 30 without being damaged by catching the edge of the blades 30. Referring to FIG. 8C, as the carrier 26 is further advanced, the protrusions 56 enter the grooves 38, allowing the blade stops 34 to return to the first or un-deflected state. The blades 30 are then biased upward by the spring arms 64 and contact the bottom surface of the blade catch 52. When the carrier 26 is in the first position (shown in FIG. 8D), located directly above the cartridge 28, the blade catch 52 drops into the blade aperture 31 to engage the topmost blade 30 in the stack. The length of the blade catch 52 and the difference in heights between the blade catch 52 and the bosses 50 is such that the blade catch 52 engages only the top cutting blade 30 and not the lower cutting blades 30 in the stack.

Referring, to FIGS. 9A-9L, a user may use the replacement apparatus 20 to replace the blade 30 on a rotary cutting tool 70. Preferably, the replacement apparatus 20 enables a user to replace the blade 30 on a rotary cutting tool 70 without needing to touch the blade 30. The user may remove or actuate a retaining feature (e.g., nut, clips, etc.) from the rotary cutter 70 (see FIG. 9A) and orient the cutting tool 70 such that the blade 30 desired to be remove d (e.g., the old blade) decouples from the cutting tool 70 (decouples from the axle or post of the cutting tool) (see FIG. 9B).

According to one embodiment, when the cutter is in a first position, the old blade decouples from the rotary cutter by the force of gravity. According to the embodiment shown, a portion of the cutting tool 70 may be removed with the blade 30. In this embodiment, the cutting tool 70 (e.g., the removable portion of the cutting tool 70) includes a magnet to retain the blade. The replacement apparatus 20 may be turned upside down to access the old blade storage area (see FIG. 9C), and the blade 30 and any removable portion of the cutting tool 70 to which the blade 30 is coupled to may be aligned with the storage area (see FIG. 9D). The blade 30 may be engaged by retaining features and held in the storage area while the removable portion of the cutting tool 70 is removed (see FIG. 9E). In this embodiment, the retaining features are stronger than the magnet incorporated in the cutting tool 70, and the retaining features cause the decoupling between the cutting tool 70 and the blade 30. The replacement apparatus 20 may then be turned over (see FIG. 9F) and actuated as described above to index a new blade from a first side of the apparatus 20 to the second side (see FIGS. 9F-9H). The removable portion of the cutting tool 70 may then be positioned such that the axle passes through the hole in the blade 30 in the trough of the replacement apparatus 20 (see FIG. 91). According to the embodiment shown, the magnet of the removable portion attracts and retains the blade 30 to the removable portion. According to another embodiment, the cutting tool 70 and the replacement apparatus 20 may be reoriented (e.g., inverted) such that the new blade 30 exits the trough and is supported on the axle of the cutting tool 70 by gravity. The replacement apparatus 20 may then be decoupled and/or removed from the cutting tool 70 (see FIG. 9J). According to the embodiment shown, the removable portion of the cutting tool 70 may be re-coupled to the cutting tool 70, and the retaining feature on the cutting tool 70 may be actuated or re-attached (see FIG. 9K). The cutting tool 70 may then be utilized with a new blade 30 (see FIG. 9L)

The applicant notes that elements in the figures may be shown inaccurately due to limitations in the CAD software used to create the drawings. For example, the spring arms 64 are shown in an uncompressed or undeflected state in the cross-section views such that they pass through the blades 30. However, those skilled in the art will understand from the figures and the description herein that the spring arms 64 press against the underside of the bottommost blade held within the cartridge 28 and are deflected downward into the cavity 60 by the blades 30.

The construction and arrangement of the elements of the rotary blade replacement apparatus as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. An apparatus for presenting a replacement blade from a cartridge, comprising:

a body including:

a bottom side and a top side opposite the bottom side, a first position and a second position laterally spaced from the first position, and a trough aligned with the second position; and a carrier slidably coupled to the body, the carrier including a boss configured to engage an opening of a blade, the carrier movable between the first position and the second position;

wherein when the carrier is in the first position, the carrier couples to the blade if a blade is present in the first position;

wherein when the carrier is in the second position, the carrier decouples from the blade such that the blade is deposited in the trough and is configured to receive an axle of a rotary cutting tool, if a blade is coupled to the carrier; and wherein when the carrier moves from the first position to the second position, the carrier causes a blade to move from the first position to the second position.

2. The apparatus of claim 1, further comprising a cartridge coupled to the body, the cartridge configured to house at least one rotary blade therein.

3. The apparatus of claim 2, wherein the cartridge is coupled to the bottom side of the body.

4. The apparatus of claim 2, wherein the cartridge comprises a spring providing a biasing force against the at least one rotary blade.

5. The apparatus of claim 1, wherein the carrier is coupled to the top side of the body.

6. The apparatus of claim 1, wherein the top side of the body comprises a floor, and wherein the trough is recessed from the floor.

7. The apparatus of claim 1, wherein the boss provides a contact surface for selective contact with a top surface of the blade.

8. The apparatus of claim 1, wherein the body comprises at least one finger proximate the first position, wherein the carrier comprises at least one protrusion, and wherein the protrusion of the carrier causes the finger to deflect from a first state to a second state as the carrier moves from the second position to the first position.

9. The apparatus of claim 8, wherein the finger comprises a groove configured to receive the protrusion, thereby allowing the finger to return from a second state to a first state when the carrier is in the first position.

10. The apparatus of claim 1, wherein the body comprises at least one rail retaining the carrier to the body.

11. The apparatus of claim 10, wherein the rail guides the carrier between the first position and the second position.

12. An apparatus for presenting a replacement blade from a cartridge, comprising a body including:

a bottom side and a top side opposite the bottom side, a first position and a second position laterally spaced from the first position, at least one finger proximate the first position, and a trough aligned with the second position and configured to receive an axle of a rotary cutting tool; and a cartridge coupled to a first side of the body, the cartridge having at least one rotary blade therein and a spring providing a biasing force against the at least on rotary blade; and a carrier comprising a boss configured to engage a hole in one of the at least one rotary blade, the carrier slidably coupled to a second side of the body and movable between the first position and the second position.

13. The apparatus of claim 12, wherein the top side of the body comprises a floor, and wherein the trough is recessed from the floor.

14. The apparatus of claim 12, wherein the carrier comprises at least one protrusion, and wherein the at least one protrusion of the carrier causes the finger to deflect from a first state to a second state as the carrier moves from the second position to the first position.

15. The apparatus of claim 14, wherein the finger comprises a groove configured to receive the protrusion, thereby allowing the finger to return from a second state to a first state when the carrier is in the first position.

16. The apparatus of claim 12, wherein the body comprises at least one rail retaining the carrier to the body, the rail guiding the carrier between the first position and the second position.

17. A method for replacing a blade of a rotary cutting tool, comprising:

providing a body comprising a first position, a second position laterally spaced from the first position, and a trough aligned with the second position;

providing a carrier slidably coupled to the body, the carrier movable between the first position and the second position;

providing a blade proximate the first position;

coupling the carrier to the blade;

moving the carrier from the first position to the second position;

depositing the blade in the trough; and positioning the body such that the hole of the blade in the trough receives the axle of a rotary cutting tool.

18. The method of claim 17, further comprising returning the carrier to the first position.

19. The method of claim 17, wherein providing a blade proximate the first position comprises coupling a cartridge having at least one blade therein to the body proximate the first position.

20. An apparatus for presenting a replacement blade from a cartridge, comprising:

a body including:

a bottom side and a top side opposite the bottom side, a first position and a second position laterally spaced from the first position, a trough aligned with the second position, and at least one finger proximate the first position; and a carrier slidably coupled to the body and moveable between the first position and the second position, the carrier including:

a boss configured to engage an opening of a blade, and at least one protrusion;

wherein when the carrier is in the first position, the carrier couples to the blade if a blade is present in the first position;

wherein when the carrier is in the second position, the carrier decouples from the blade such that the blade is deposited in the trough, if a blade is coupled to the carrier;

wherein when the carrier moves from the first position to the second position, the carrier causes a blade to move from the first position to the second position; and wherein the protrusion of the carrier causes the at least one finger of the body to deflect from a first state to a second state as the carrier moves from the second position to the first position.

21. The apparatus of claim 20, wherein the at least one finger comprises a groove configured to receive the protrusion, thereby allowing the at least one finger to return from the second state to the first state when the carrier is in the first position.

* * * * *